US007395926B2

(12) United States Patent
Petri

(10) Patent No.: US 7,395,926 B2
(45) Date of Patent: Jul. 8, 2008

(54) PACKAGING FOR A PLANT CONTAINER

(75) Inventor: Richard Petri, Montabaur-Horrssen (DE)

(73) Assignee: Mars, Inc., McLean, VA (US)

( * ) Notice: Subject to any disclaimer, the term of this patent is extended or adjusted under 35 U.S.C. 154(b) by 337 days.

(21) Appl. No.: 10/504,378

(22) PCT Filed: Jan. 24, 2003

(86) PCT No.: PCT/EP03/00720

§ 371 (c)(1),
(2), (4) Date: Mar. 30, 2005

(87) PCT Pub. No.: WO03/068617

PCT Pub. Date: Aug. 21, 2003

(65) Prior Publication Data

US 2005/0173282 A1 Aug. 11, 2005

(30) Foreign Application Priority Data

Feb. 18, 2002 (DE) ..... 102 06 682

(51) Int. Cl.
*B65D 85/52* (2006.01)
*A01G 9/02* (2006.01)

(52) U.S. Cl. ..... 206/423; 47/84; 206/784

(58) Field of Classification Search ..... 206/423, 206/784; 229/122.31; 47/41.01, 84
See application file for complete search history.

(56) References Cited

U.S. PATENT DOCUMENTS

| | | | | | |
|---|---|---|---|---|---|
| 786,547 | A | * | 4/1905 | Chamberlin | 206/423 |
| 2,160,998 | A | * | 6/1939 | Wilson | 47/84 |
| 2,767,831 | A | * | 10/1956 | Brecht | 206/423 |
| 2,814,910 | A | * | 12/1957 | Reparon | 47/84 |
| 3,973,356 | A | * | 8/1976 | Schacht | 47/41.01 |
| 4,242,835 | A | * | 1/1981 | Mondragon Sorribes | 47/84 |
| 4,299,054 | A | * | 11/1981 | Ware | 47/64 |
| 4,936,046 | A | * | 6/1990 | Miller | 47/41.01 |

FOREIGN PATENT DOCUMENTS

| | | |
|---|---|---|
| DE | 7519798 | 9/1975 |
| DE | 2 909 378 | 3/1979 |
| DE | 79 19 393 | 7/1979 |
| DE | 35 14796 | 10/1986 |
| GB | 2 168 327 | 6/1986 |
| NL | 525491 | 1/1954 |
| WO | WO-94/20389 | 9/1994 |

* cited by examiner

*Primary Examiner*—Bryon P Gehman
(74) *Attorney, Agent, or Firm*—Fulbright & Jaworski; Jan K. Simpson

(57) ABSTRACT

Packaging for protecting or for sending of plants or plant containers in which the packaging is formed from at least two parts. A lower part is connected to an upper part in such a manner that a recess is present between a wall of the lower part and an inner wall of the upper part and in which recess a plant container is secured against movement or displacement.

12 Claims, 1 Drawing Sheet

PACKAGING FOR A PLANT CONTAINER

CROSS-REFERENCE TO RELATED APPLICATIONS

This application is a national stage of PCT/EP03/00720 filed on Jan. 24, 2003 claiming priority to DE 10206682.5 filed on Feb. 18, 2002.

TECHNICAL FIELD

The present invention relates to packaging employed in transport and protection of products, in particular, plants and plant containers such as pots, vases and the like.

BACKGROUND OF THE INVENTION

Known packaging systems which are currently available in the marketplace use materials such as cardboard, paper, corrugated cardboard and plastic materials. It is additional known to fill up boxes and containers in which fragile and delicate goods and products are to be transported with chips made out of plastic materials, cardboard, paper or natural products such as starch.

The known packaging systems are not optimal for the complicated transport of highly delicate plants and breakable plant containers. For example, if plants are packaged using chips and corresponding packaging shrouds, such packaging is likely to cause mechanical and physiological damage to the plant. Adding to this problem is that there are no standard packaging systems for plants which make it possible to protect the delicate plant parts above ground and simultaneously prevent breakage of the container in which the plant is potted.

It is one aim of the invention to provide a packaging system which enables a safe transport of plant or plant containers.

BRIEF SUMMARY OF THE INVENTION

In accordance with the invention, the above aim is solved in that the packaging for protecting and transport of plants or plant containers comprises at least two parts, of which parts a lower part is connected to an upper part in such a manner that a recess or void is present between the wall of the lower part and the inner wall of the upper part and in which the plant container is secured against movement or displacement.

In a preferred form, the packaging is made of wood, plastic materials, cardboard, metal, glass fibers, plexiglass, glass or combinations thereof.

In a preferred embodiment, the outer wall of the upper part borders the recess and defines a shrouded volume with respect to the surrounding environment.

In a further embodiment, the walls of the upper part and the wall of the lower part include ventilation openings.

In a further embodiment, the walls of the upper part and the walls of the lower part are stanchion or frame-like in configuration.

Preferably, the inner wall of the upper part and the outer wall of the upper part are connected in a fixed manner with respect to one another.

It is preferred that the inner diameter of the upper part above the recess and the inner diameter of the lower part are smaller than the inner diameter of the upper part of the level of the recess.

In a particularly preferred embodiment, the inner diameter of the upper part above the recess and the inner diameter of the lower part have the same dimension.

In a preferred embodiment, the recess is configured to extend peripherally. Alternatively, the recess is discontinuous in extension.

Advantageously, the upper and the lower parts are closed by way of respective lids.

In a particularly preferred form, the plant is secured within the packaging by means of a suitable device.

This device within the packaging can comprise alternatively a net, paper, cardboard, plexiglass, glass, glass fibers, plastic materials, metal, wood or combinations thereof.

In a particularly preferred embodiment of the packaging, the latter has a substantially circular cross-section.

Alternatively, the packaging can have a cross-section which is substantially canted or polygonal.

In a preferred embodiment of the packaging, the latter is lined on its inside with plastic materials, wood, cardboard, paper, glass fibers, foil or bubble foil.

The packaging in accordance with the invention provides for the plant to be transported to have a secure support within the arrested plant container and provides for optimum transport conditions. This, in turn, enables the plant to be easily packaged and presented in a ready to use state whilst simultaneously being readily transportable without incurring excessive packaging costs when packaged for parcel delivery, minimizing harm to the plant during transport, and as consequence of the packaging procedure, and preventing breakage of the plant container.

In creating a stable void or hollow space in which the plant is received within the packaging it is ensured in particular that the delicate leaves and buds are not stressed excessively and potentially subject to breakage, bending or buckling as consequence of mechanical influences/actions thereon. The plant itself can, if desired, be supported using a suitable device within the packaging. Sleeves made from a variety of materials come to mind as an example of such devices. In order to protect against impacts there is also provided a hollow space below the plant container. The transport system which comprises a plug-in assembly of parts enable a flexible adaptation to individual shapes and/or sizes of the plant container to be transported therewith, the transport position being secured or fixed by means of adhesive tape, for example. The recess by means of which the plant container is fixed and/or localized within the packaging can extend peripherally (ie, be continuous within the packaging). In cases where the plant container (eg pot) is not circular in cross-section pr is provided with discrete small protrusions at certain locations, it is possible to provide for a discontinuous recess. Such non-continuous recess can also be advantageous if the plant container is to be arrested/fixed in a certain position and orientation such as to present or display the plant with a specific: "face", which can play an important role where the packaging includes a display window.

Transportation of plants in a plant container (eg pot, vase or similar) has numerous advantages. For one, the roots of the plant are protected from damage. This may play an important role with plant types which have succulent roots that are prone to breaking and thus may cause trauma to the plant during and after transport. It is also advantageous that the plant may already be presented in a decorative vase or pot which is also protected by the packaging, thus avoiding the need to transfer or re-pot the plant after receipt of a packaged plant parcel. Maintenance of an as far as possible stable life supporting environment can be of paramount importance for rare and/or delicate plants.

The invention will be described in greater detail in the following by way of reference to an embodiment thereof.

DETAILED DESCRIPTION OF THE INVENTION

Figure 1:
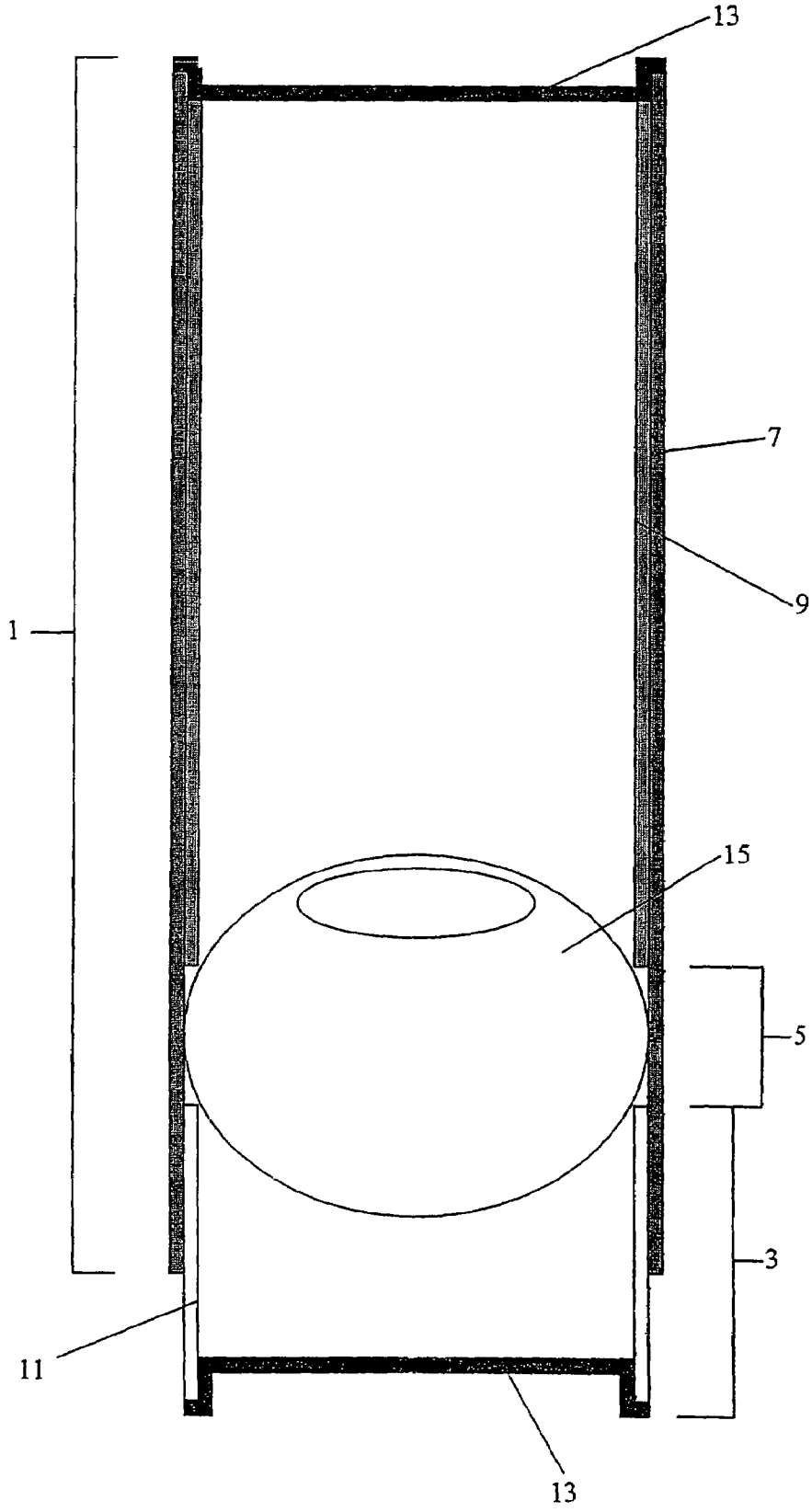
FIG. 1 shows a longitudinal section of a packaging in accordance with an embodiment of the invention.

The packaging of FIG. 1 shows the assembled parts 1 and 3. The lower part 3 can be inserted into the upper part 1 to such an extent that the plant container 13 is clamped between the lower edge of the inner wall 9 of the upper part 1 and the upper edge of the wall 11 of the lower part 3. The plant container is thereby arrested (and located) within the recess 5 of the packaging, the hollow parts 1, 3 providing enough room above the retained plant container for the leaves and buds of the plant and provides a protective air cushion for the container underneath it. The parts of the packaging which are thus connected can be secured with respect to one another using adhesive tape or any other suitable fastening means, thereby to prevent disengagement of the parts 13 during transport. In order to prevent spilling of the soil or soil granules received within the plant container during transport of the parceled and packaged plant, the container opening around the plant parts (eg stem) can be covered with a special net, paper, cellulose, plastic materials and similar. The plant portions located above ground are thereby protected from mechanical and thermal loads, and may be additionally supported with regards to their stability by means of collars provided specifically for such purpose. Alternatively, the packaging may be padded with a variety of different and suitable materials in order to prevent temperature changes and absorb impacts on the packaging. It is also possible to substitute the above described walls (which are devised as continuous planar structures) by a supporting grid of discrete webs and the like which equally form an upper and lower part that achieve the advantages of the packaging system and/or provide additional ventilation openings.

The packaging illustrated in FIG. 1 is regularly between 15 cm to 150 cm in height and has a diameter of between 7.5 cm and about 90 cm. These dimensions are, however, individually, in combination or in their numeric values variable, since the packaging system can be conformed to the plants and plant containers that are to be packaged in a ready to use manner and transported.

The inventive packaging system enables safe transport of valuable and delicate plants and plant containers (eg pots and the like).

The features according to the invention described in the above description and the claims and illustrated in the drawing can be essential individually or in any desired combination in the process of providing the different embodiments of the present invention.

What is claimed is:

1. Packaging for protecting or for sending of plants or plant containers, the packaging comprising:

at least two parts, a lower part having a substantially straight side wall that is inserted into an upper part;

the upper part having a substantially straight inner wall and a substantially straight outer wall that are in adjoining arrangement with each other;

the lower and upper parts are configured such that a recess is present between an upper edge of the side wall of the lower part and a lower edge of the inner wall of the upper part when the lower part and the upper part are connected in a fixed manner with respect to one another;

the recess being configured to allow a plant container to be clamped and secured in the recess against movement;

the outer wall of the upper part borders the recess and defines a shrouded volume with respect to the surrounding environment;

wherein the walls of the upper part and the walls of the lower part are frame-like in configuration.

2. Packaging according to claim 1, wherein the packaging is made from material selected from a group consisting of wood, plastic materials, cardboard, metal, glass fibers, plexiglass, glass and combinations thereof.

3. Packaging according to claim 1, wherein walls of the upper part and walls of the lower part include ventilation openings.

4. Packaging according to claim 1, further comprising upper and lower parts having an inner diameter, wherein the inner diameter of the upper part above the recess, and the inner diameter of the lower part, are smaller than the inner diameter of the upper part at the level of the recess.

5. Packaging according to claim 4, wherein the inner diameter of the upper part above the recess and the inner diameter of the lower part have the same dimension.

6. Packaging according to claim 1, wherein the recess is configured to extend continuously within the packaging.

7. Packaging according to claim 1, wherein the upper and lower parts are closed by way of respective lids.

8. Packaging according to claim 1, wherein a plant is secured within the packaging by means of a suitable device.

9. Packaging according to claim 8, wherein the device within the packaging comprises a device selected from a group consisting of a net, paper, cardboard, plexiglass, glass, glass fibers, plastic materials, metal, wood and combinations thereof.

10. Packaging according to claim 1, wherein the packaging has a substantially circular cross-section.

11. Packaging according to claim 1, wherein the packaging has a cross-section which is substantially polygonal.

12. Packaging according to claim 1, wherein the packaging is lined on its inside with material selected from a group consisting of plastic materials, wood, cardboard, paper, glass fibers, foil and bubble foil.

* * * * *